US008555418B2

(12) United States Patent
Singh et al.

(10) Patent No.: US 8,555,418 B2
(45) Date of Patent: Oct. 15, 2013

(54) COMBINATION HAT AND FACE COVERING

(76) Inventors: Jagvir Singh, Huntington, NY (US); Michael Tizol, Deer Park, NY (US)

( * ) Notice: Subject to any disclaimer, the term of this patent is extended or adjusted under 35 U.S.C. 154(b) by 22 days.

(21) Appl. No.: 13/136,871

(22) Filed: Aug. 12, 2011

(65) Prior Publication Data

US 2012/0066813 A1 Mar. 22, 2012

Related U.S. Application Data

(60) Provisional application No. 61/401,430, filed on Aug. 12, 2010.

(51) Int. Cl.
*A42B 1/18* (2006.01)

(52) U.S. Cl.
USPC ..... 2/173

(58) Field of Classification Search
USPC ..... 2/173, 202, 203, 204, 205, 206, 208, 2/171, 171.4, 4, 9, 423, 424
See application file for complete search history.

(56) References Cited

U.S. PATENT DOCUMENTS

| | | | | |
|---|---|---|---|---|
| 5,575,009 | A * | 11/1996 | Ryvin | 2/173 |
| 5,713,077 | A * | 2/1998 | Humbrecht | 2/173 |
| 5,839,432 | A * | 11/1998 | Daneshvar | 128/201.25 |
| 5,845,340 | A * | 12/1998 | Frislie | 2/202 |
| 7,240,372 | B2 * | 7/2007 | Larson | 2/173 |
| 7,308,721 | B1 * | 12/2007 | Rivera, Jr. | 2/207 |
| 7,488,068 | B2 * | 2/2009 | Welchel et al. | 351/158 |
| 7,603,724 | B2 * | 10/2009 | Mickle | 2/173 |

* cited by examiner

*Primary Examiner* — Tejash Patel
(74) *Attorney, Agent, or Firm* — Philip M. Weiss; Weiss & Weiss

(57) ABSTRACT

A combination hat/face covering which comprises a hat for covering the entire head and an attachment for covering parts of the face.

16 Claims, 8 Drawing Sheets

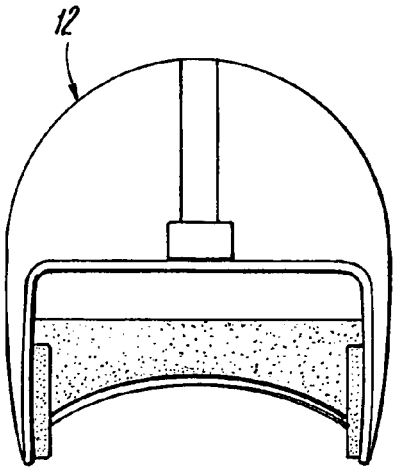
Fig. 5
Fig. 7
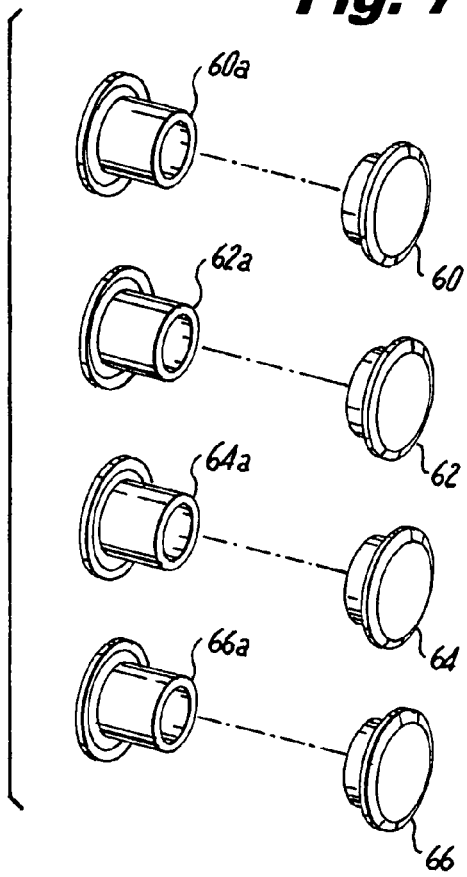
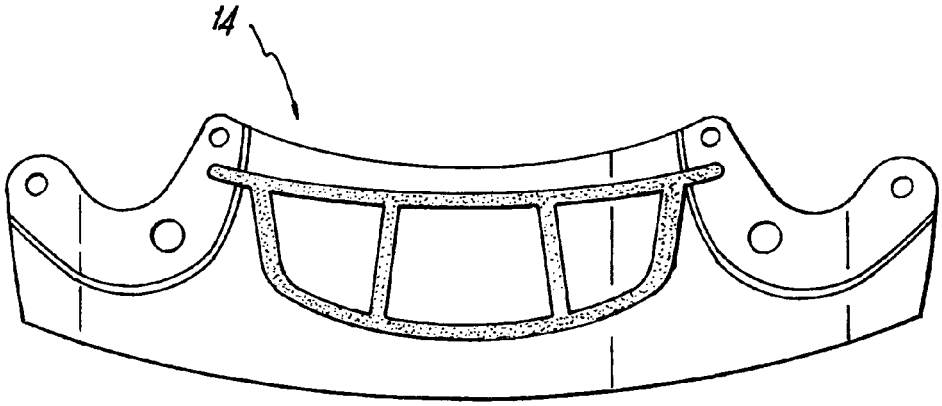
Fig. 6

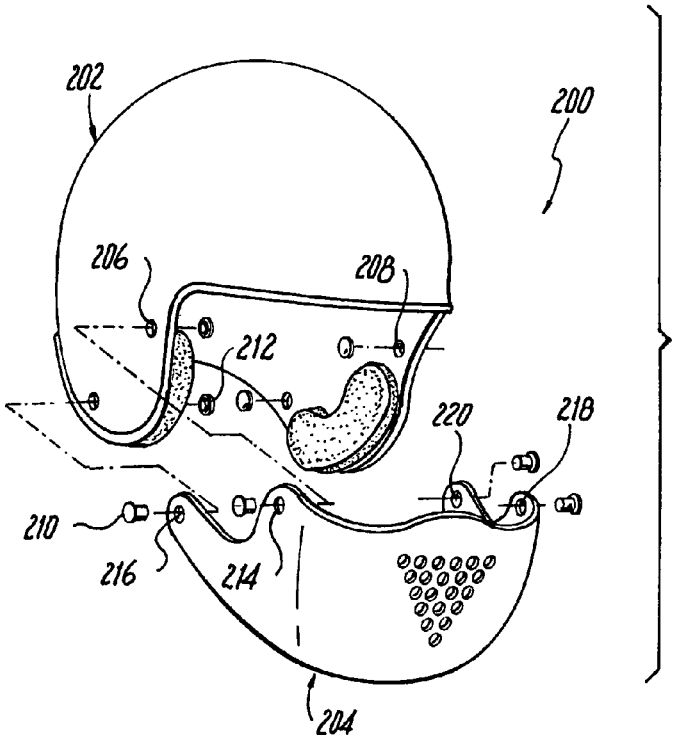
Fig. 12
Fig. 13
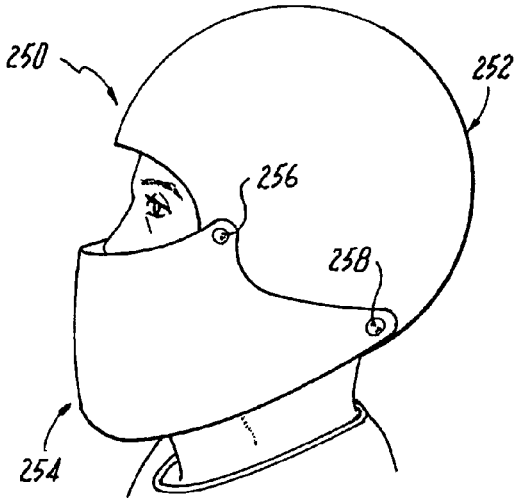
Fig. 14
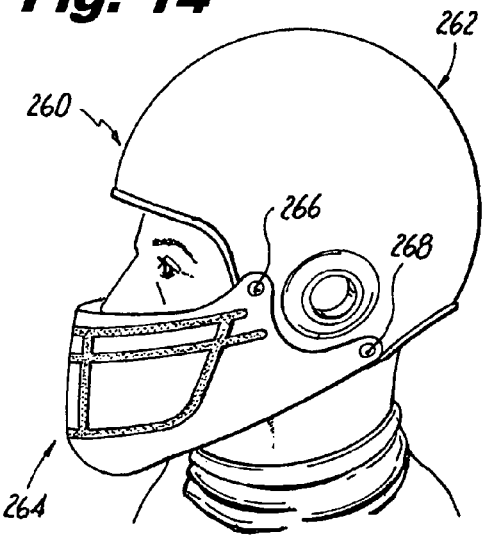

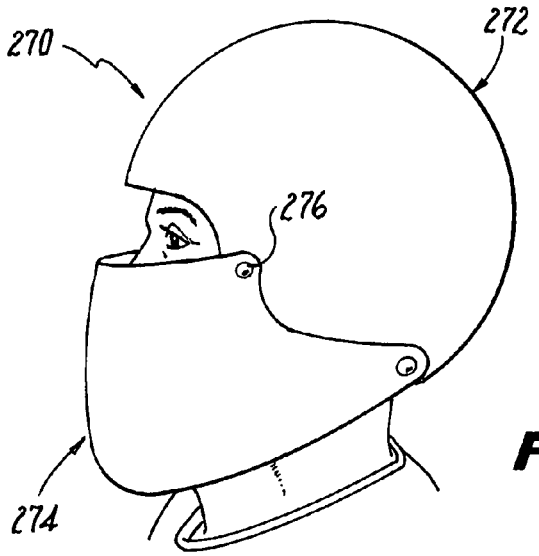
Fig. 15
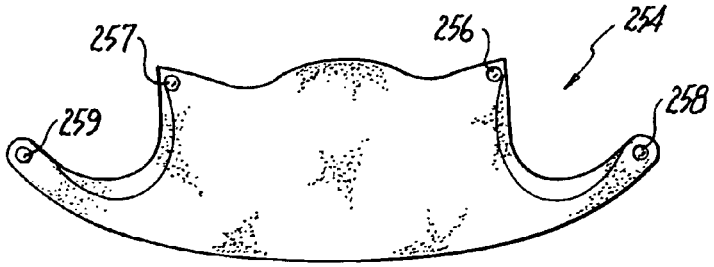
Fig. 16
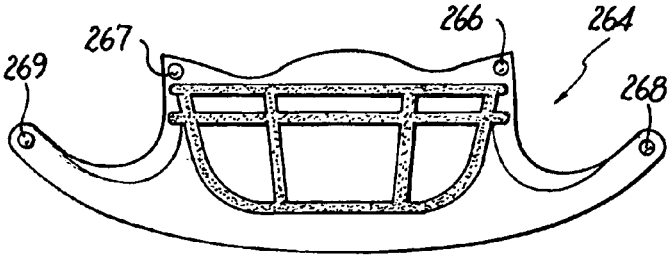
Fig. 17
Fig. 18
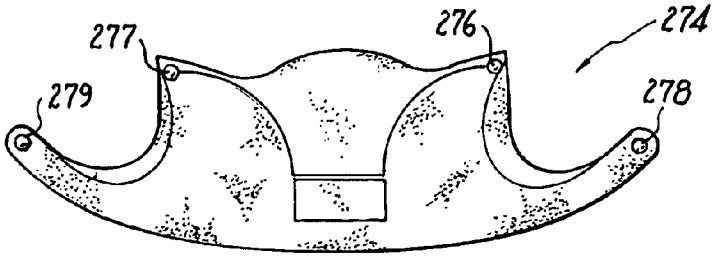

COMBINATION HAT AND FACE COVERING

RELATED APPLICATIONS

This application is based on provisional patent application Ser. No. 61/401,430 filed Aug. 12, 2010.

FIELD OF THE INVENTION

A combination hat/face covering which comprises a hat for covering the entire head and an attachment for covering parts of the face.

BACKGROUND OF THE INVENTION

U.S. Pat. No. 7,681,251 relates to a hat member having a lower rim with a scarf attached which extends between the temple areas around the back of the head. The scarf extends from the rim down to the neck. The hat member has a crown into which the scarf member can be positioned and stored.

U.S. Pat. No. 5,685,017 relates to a hat including a head band shaped to fit around the circumference of a head. The headband has at least one hat component consisting of a hat crown, visor, neck curtain, ear muffs and a utility strap.

U.S. Pat. No. 5,226,189 relates to a hunting hood with nylon net face cover.

U.S. Pat. No. 5,771,493 relates to a head wear system including a sizing band and a hat. The hat comprises a bill and a cap having an opening at the back as well as a headband. The head wear system comprises an ornament, a cover means for accessorizing the hat, and an attachment means for connecting the cover means and the ornament to the crown of the cap.

U.S. Design Pat. 367,549 and 282,405 relate to combined hat and face masks.

U.S. Pat. No. 5,551,087 relates to a hat and face mask combination which includes a hat made of stretchable knit material and a peripheral edge defining an opening for the face of the wearer. The hat also includes a lower portion that is rollable over on itself to form an ear covering of double thickness. The head covering also includes a face mask that ends over the face opening and includes a periphery sewn to the hat along the periphery of the face opening.

U.S. Design Pat. 563,081 relates to a face mask and hat for use with same.

U.S. Pat. No. 7,240,372 relates to a multi-purpose head covering which includes a hat capable of covering at least a portion of the head and a mask capable of covering a portion of the face. The mask has a central body and two extensions on either side. Each of the two extensions comprises a mask attachment member for attachment to the hat. The mask includes a number of releasable fasteners, such as snaps, such that when the releasable fasteners are engaged to one another, the size of the mask changes.

U.S. Design Pat. 559,502 relates to a helmet shaped hat with face mask.

SUMMARY OF THE INVENTION

The present invention relates to a head and face cover combination. The head cover comprises a hat which covers the entire head including the forehead and ears of the wearer.

It is an object of the present invention for the material of the hat to be made of wool, acrylic yarn, neoprene, apex, fleece, mesh, cotton, leather, suede, spandex, silk, fur, artificial silk, sinew, catgut, angora, mohair, alpaca, rayon (artificial, not synthetic), acetate (artificial, not synthetic), nylon, modacrylic, olefin, acrylic, polyester, carbon fiber, specialty synthetic fibers including: vinyon, saran, vinalon, aramids—known as nomex, kevlar and twaron, modal, dyneema/spectra, PBI (polybenzimidazole fiber), sulfar, lyocell, polylactic acid, M-5 (PIPD fiber), orlon, zylon (PBO fiber), vectran (TLCP fiber) made from vectra LCP polymer and derclon.

It is an object of the present invention for the hat to provide breathability to the user.

It is an object of the present invention for the hat to provide warmth in cold temperatures.

It is an object of the present invention for the head covering to be attached to a material which covers the chin and mouth region of a user.

It is an object of the present invention for the face covering to cover the chin, mouth and nose area of a user.

It is an object of the present invention for the face covering to cover all portions of a user's face other than their eyes.

It is an object of the present invention for the face cover to be releasably attached to the head cover.

It is an object of the present invention for the head cover and face cover to be attached by snap buttons, Velcro, or other releasably attachment devices.

It is an object of the present invention for the device to have two buttons on either side of the head cover so that the face cover can be attached thereto.

It is an object of the present invention for the wearer to have the option of having their face covered along with their head.

It is an object of the present invention for the attachments to allow the device to continue to be attached to cover a user's chin, yet allow access to the user's mouth so the user can eat, drink and talk while wearing the device.

It is an object of the present invention for the hat and face covering to come in all sizes to fit men, women and children.

It is an object of the present invention for the face covering to be made of different colors, graphics and logos.

It is an object of the present invention for a user to have different combinations of hat and face covers.

It is an object of the present invention for a user to be able to add and remove logos onto either the hat covering and/or the face covering.

It is an object of the present invention for the head covering to be interchangeable with different face coverings. It is an object of the present invention for the face covering to be contoured to fit over the nose, mouth, chin and neck.

It is an object of the present invention for the face covering to be attached to the hat with four snap buttons. It is an object of the present invention for there to be two snap buttons located on the side of the face just below the temple and the two other buttons to be located on the back of the neck.

It is an object of the present invention for the materials to be used on the face covering to be weather proof.

It is an object of the present invention for the materials to be used on the face mask to be moisture wicking.

It is an object of the present invention for the device to be used in combination with protective eye coverings, such as goggles or glasses.

BRIEF DESCRIPTION OF THE DRAWINGS

FIG. 5 shows a front view of the head covering of the present invention.

FIG. 6 shows a front view of the face covering of the present invention.

FIG. 7 shows an embodiment of the attachments of the present invention.

FIG. 12 shows an exploded view of an embodiment of a device of the present invention.

FIG. 13 shows a side view of the device of the present invention.

FIG. 14 shows a side view of the device of the present invention.

FIG. 15 shows a side view of the device of the present invention.

FIG. 16 shows a front view of the face covering of the present invention.

FIG. 17 shows a front view of the face covering of the present invention.

FIG. 18 shows a front view of the face covering of the present invention.

DETAILED DESCRIPTION OF THE INVENTION

Figure 1:
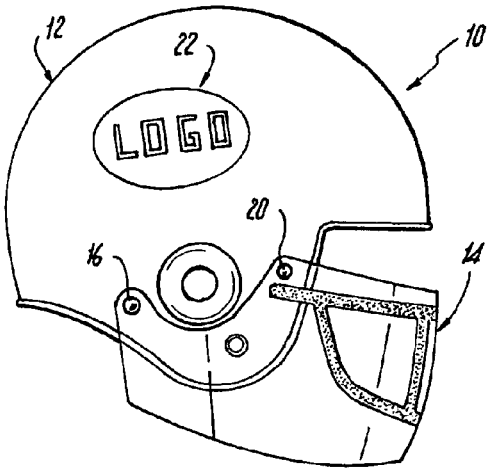
FIG. 1 shows a side view of the device of the present invention.

FIG. 1 shows a side view of the device 10 having a head covering 12 and a face covering 14. The face covering 14 covering the chin, mouth and nose of a wearer. In the embodiment shown in FIG. 1 the device looks like a football helmet. The device 10 also has attachment devices 16, 20 for attaching the face cover 14 to the head cover 12. FIG. 1 also shows a logo 22 on the head covering 12.

Figure 2:
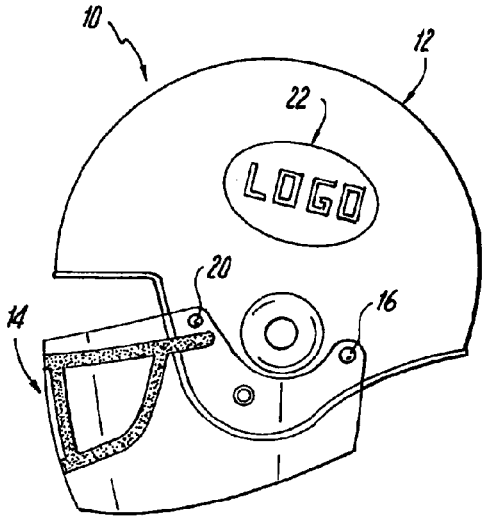
FIG. 2 shows a side view of the device of the present invention.

FIG. 2 shows the same device 10 as FIG. 1 shown from the opposite side.

Figure 3:
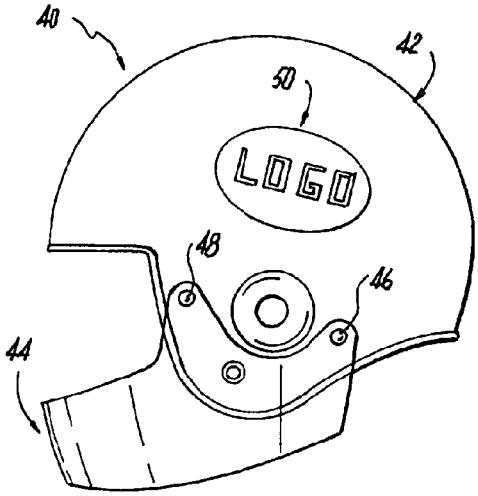
FIG. 3 shows a side view of the device of the present invention.

FIG. 3 shows a device 40 having a head covering 42 and a face covering 44. The face covering covers the chin and mouth of the user but allows space for the nose and eyes. The device 40 also has attachment devices 46 and 48. The head covering further has a logo 50.

Figure 4:
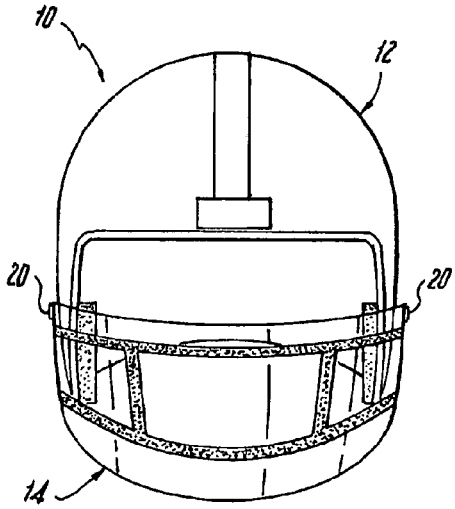
FIG. 4 shows a front view of the device of the present invention.

FIG. 4 shows a front view of the device shown in FIGS. 1 and 2.

FIG. 5 shows the head covering 12 separate and apart from the face covering 14.

FIG. 6 shows the face covering 14 separate and apart from the head covering 12.

FIG. 7 shows the attachment devices 60, 60*a*, 62, 62*a*, 64, 64*a* and 66, 66*a*.

Figure 8:
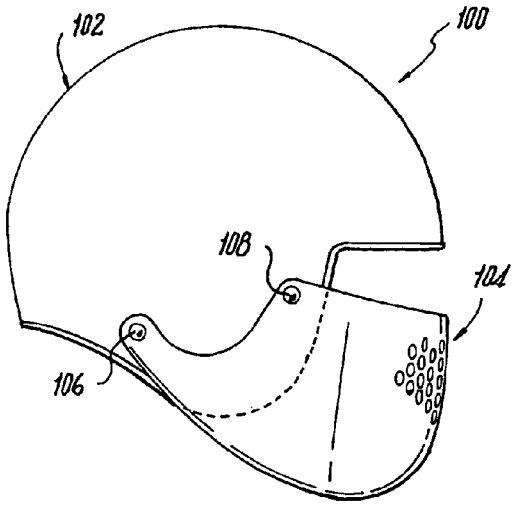
FIG. 8 shows a side view of the device of the present invention.

FIG. 8 shows a side view of the device 100 having a head covering 102 and a face covering 104. The face covering 104 covering the chin, mouth and nose of a wearer. In the embodiment shown in FIG. 8 the device looks like a football helmet. The device 10 also has attachment devices 106, 108, for attaching the face cover 104 to the head cover 102.

Figure 9:
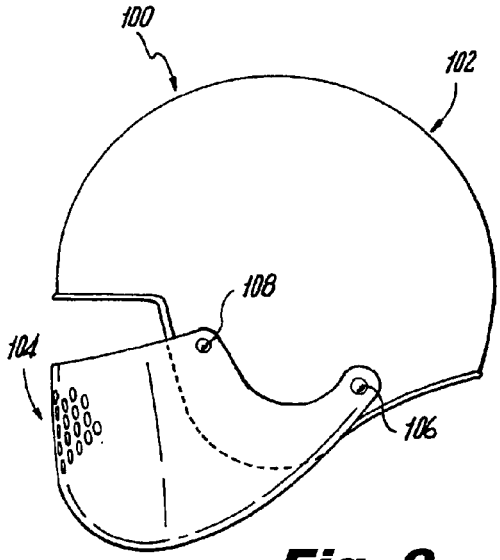
FIG. 9 shows a side view of the device of the present invention.

FIG. 9 shows the same device 100 as FIG. 8 shown from the opposite side.

Figure 10:
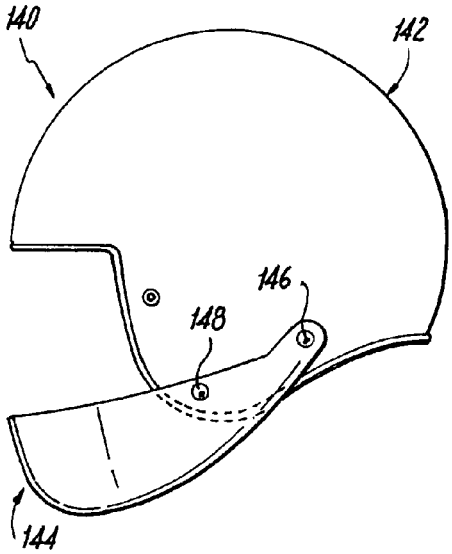
FIG. 10 shows a side view of the device of the present invention.

FIG. 10 shows a device 140 having a head covering 142 and a face covering 144. The face covering covers the chin and mouth of the user but allows space for the nose and eyes. The device 140 also has attachment devices 146 and 148.

Figure 11:
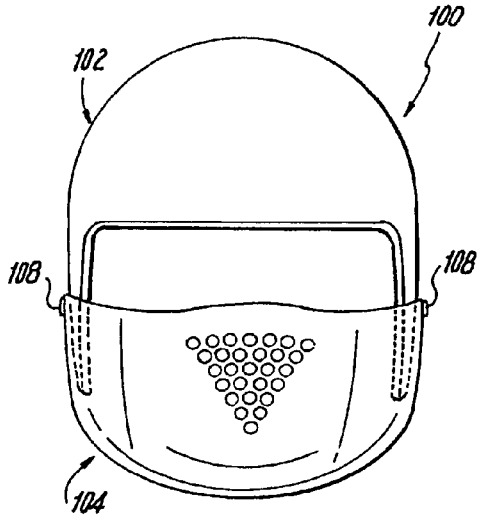
FIG. 11 shows a front view of the device of the present invention.

FIG. 11 shows a front view of the device shown in FIGS. 8 and 9.

FIG. 12 shows a device 200 having a head cover 202 and a face cover 204. The head cover has openings 206 and 208 for receiving devices 210 and 212 which attach the head cover 202 to the face cover 204. The devices 210 and 212 attach through the openings in the face cover 214, 216, 218 and 220.

FIG. 13 shows a device 250 having a head covering 252 and a face covering 254 attached by snaps 256 and 258.

FIG. 14 shows a device 260 that looks like a football helmet having a head covering 262 and a face covering 264 attached by snaps 266 and 268.

FIG. 15 shows a device 270 having a head covering 272, a face covering 274 and a snap 276.

FIG. 16 shows the face covering 254 having snaps 256, 257, 258 and 259.

FIG. 17 shows a face covering 264 having snaps 266, 267, 268 and 269.

FIG. 18 shows a face covering 274 having snaps 276, 277, 278 and 279.

Figure 19:
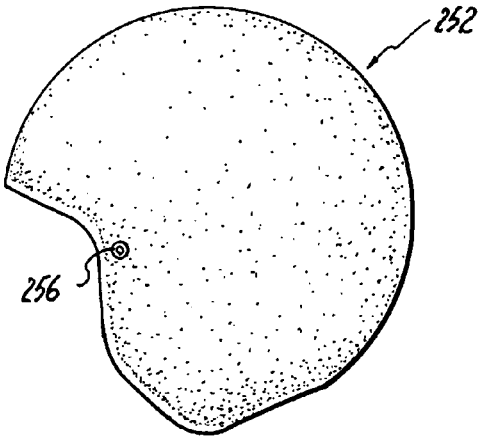
FIG. 19 shows a side view of the head covering of the present invention.

FIG. 19 shows a head covering 252 having snap 256.

Figure 20:
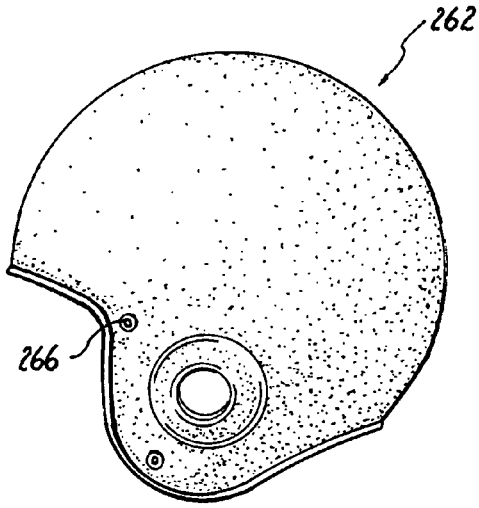
FIG. 20 shows a side view of the head covering of the present invention.

FIG. 20 shows a head covering 262 having a snap 266.

Figure 21:
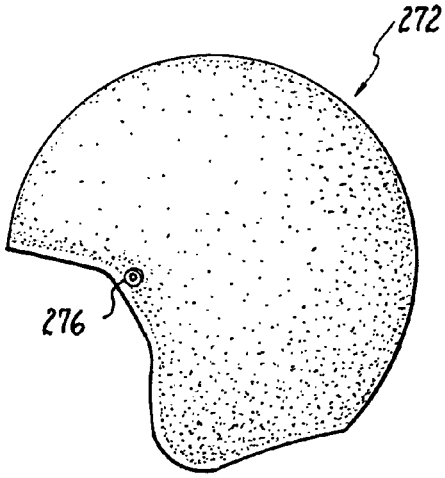
FIG. 21 shows a side view of the head covering of the present invention.
Figure 22:
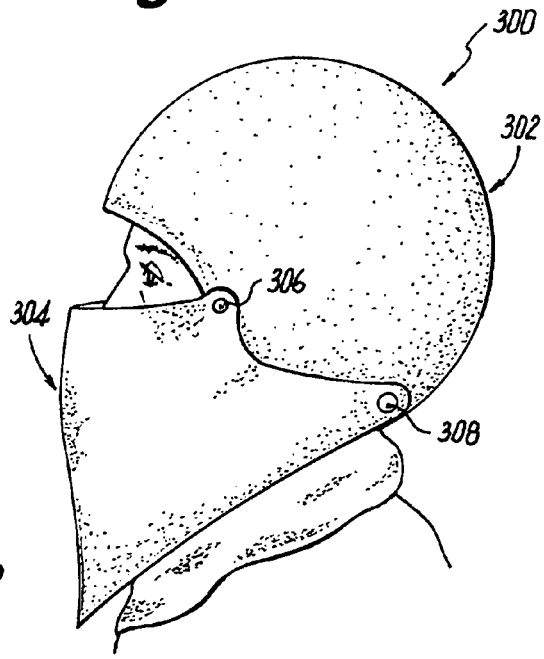
FIG. 22 shows a side view of the device of the present invention.
Figure 23:
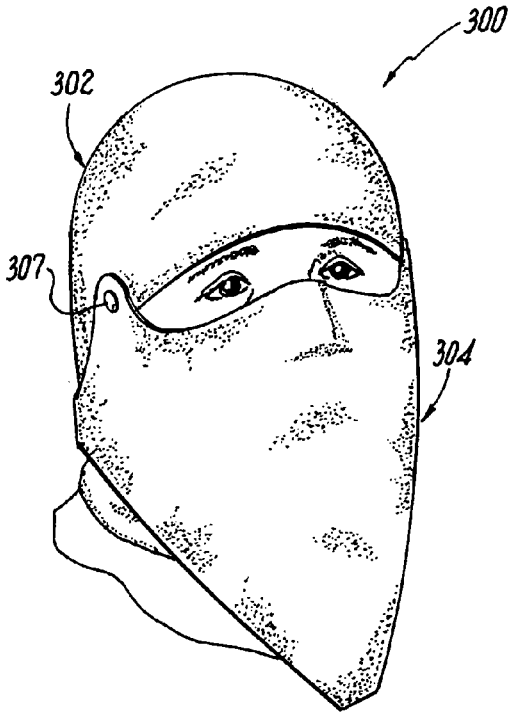
FIG. 23 shows a front view of the device of the present invention.
Figure 24:
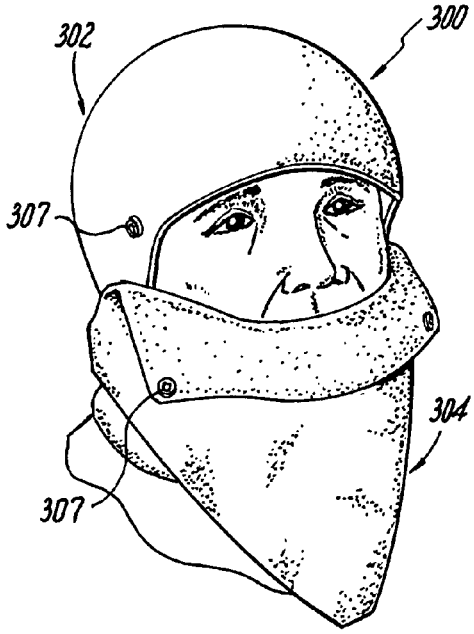
FIG. 24 shows a front view of the device of the present invention.

FIG. 21 shows a head covering 272 having a snap 276.

Figure 26:
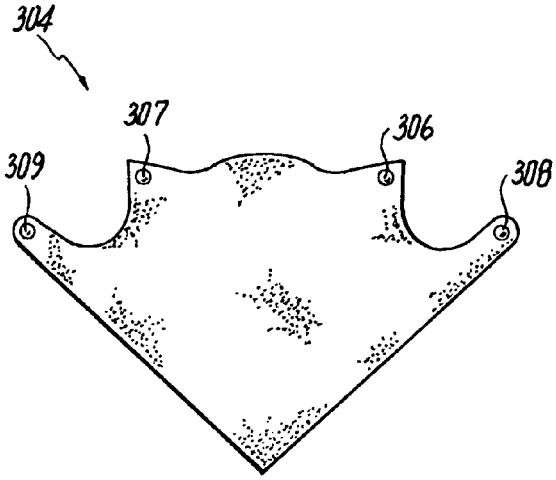
FIG. 26 shows a front view of the face covering of the present invention.
Figure 25:
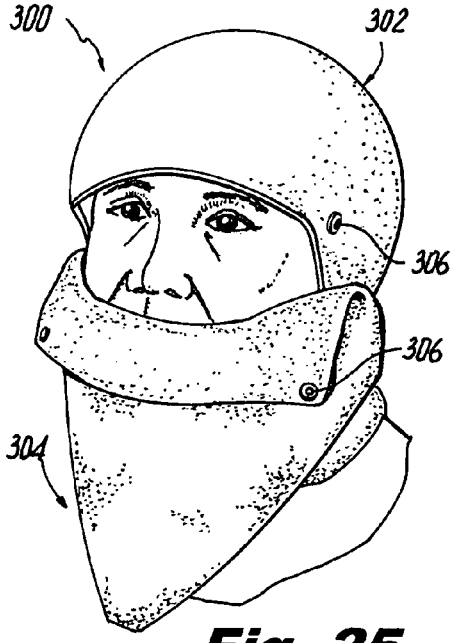
FIG. 25 shows a front view of the device of the present invention.
Figure 27:
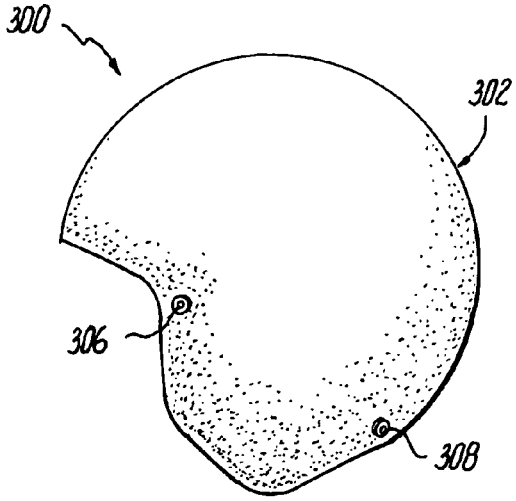
FIG. 27 shows a side view of the head covering of the present invention.
Figure 28:
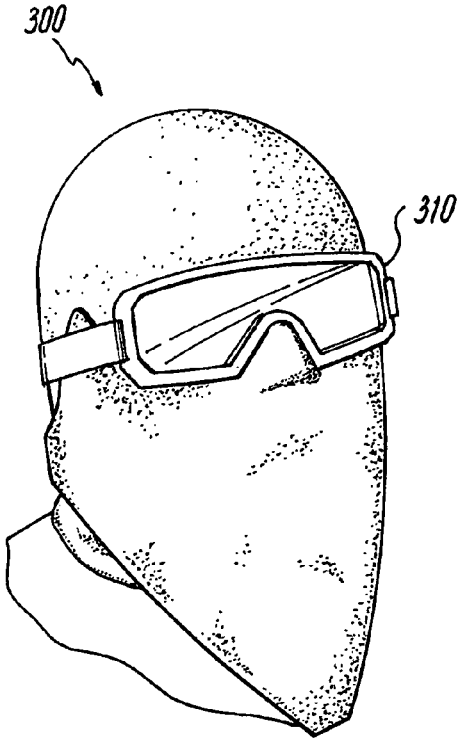
FIG. 28 shows a side view of the device of the present invention.
Figure 29:
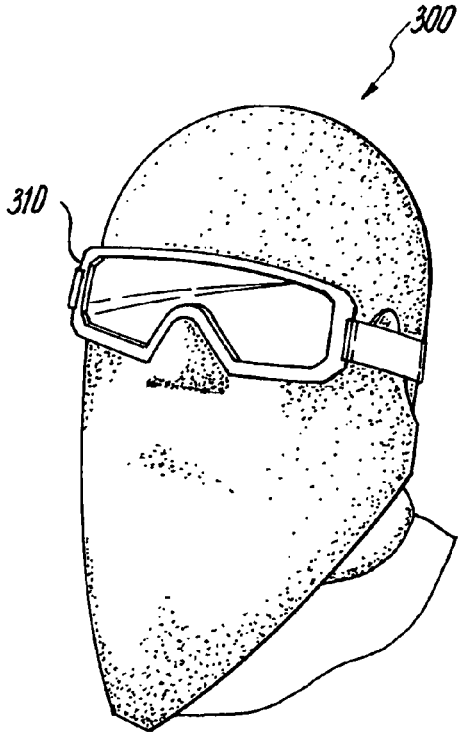
FIG. 29 shows a side view of the device of the present invention.

FIGS. 22-25 show the device 300 having a head covering 302 and face covering 304 and snaps 306, 307 and 308. FIG. 26 shows the face covering 304 having snaps 306, 307, 308 and 309. FIG. 27 shows the head covering 302 having snaps 306 and 308. FIGS. 28 and 29 show the device 300 being used with goggles 310.

The invention claimed is:

1. A device for covering the head and face comprising:

a head cover;

said head cover covering entire head including forehead and ears of wearer;

a face cover;

said face cover releasably attached to said head cover;

said face cover covering said chin and mouth region of said wearer;

wherein said head cover is made of wool, acrylic yarn, neoprene, apex, fleece and/or mesh.

2. The device of claim 1 wherein said face cover is made of wool, acrylic yarn, neoprene, apex, fleece and/or mesh, wool, acrylic yarn, neoprene, apex, fleece and mesh, cotton, leather, suede, spandex, silk, fur, artificial silk, sinew, catgut, angora, mohair, alpaca, rayon (artificial, not synthetic), acetate (artificial, not synthetic), nylon, modacrylic, olefin, acrylic, polyester, carbon fiber, specialty synthetic fibers including: vinyon, saran, vinalon, aramids—known as nomex, kevlar and twaron, modal, dyneema/spectra, PBI (polybenzimidazole fiber), sulfar, lyocell, polylactic acid, M-5 (PIPD fiber), orlon, zylon (PBO fiber), vectran (TLCP fiber) made from vectra LCP polymer and derclon.

3. The device of claim 1 wherein said face cover further covers a nose and cheeks of said wearer.

4. The device of claim 1 wherein said face cover covers all portions of a user's face other than their eyes.

5. The device of claim 1 wherein said face cover and said head cover are attached by snap buttons, hook and loop material, or other releasable attachment devices.

6. The device of claim 1 wherein said face cover and said head cover are attached by at least two buttons on either side of said head cover so that said face cover can be attached thereto.

7. The device of claim 6 wherein said face cover is attached by at least one button, and having at least one button not attached.

8. The device of claim 1 wherein said head cover and/or said face cover comprises graphics and/or a logo.

9. The device of claim 1 wherein different combinations of hat and face covers are attached to each other.

10. The device of claim 1 wherein said head coverings are interchangeable with different face coverings.

11. The device of claim 1 wherein said face covering is contoured to fit over the nose, mouth, chin and neck.

12. The device of claim 1 wherein said face covering is attached to said head covering with four snap buttons.

13. The device of claim 12 wherein two snap buttons are located on side of face just below temple and the two other buttons are located on back of neck.

14. The device of claim 1 wherein material used to make face covering is weather proof.

15. The device of claim 1 wherein materials used on face mask is moisture wicking.

16. The device of claim 1 wherein said device is used in combination with protective eye coverings, such as goggles or glasses.

* * * * *